US005884368A

United States Patent [19]

Boe

[11] Patent Number: 5,884,368

[45] Date of Patent: Mar. 23, 1999

[54] METHOD FOR REMOVABLY COUPLING A PLURALITY OF STRUCTURES

[75] Inventor: Craig L. Boe, Nampa, Id.

[73] Assignee: Micron Electronics, Inc., Nampa, Id.

[21] Appl. No.: 964,801

[22] Filed: Nov. 6, 1997

[51] Int. Cl.[6] ..... B65D 63/00

[52] U.S. Cl. ..... 24/16 PB; 24/17 AP; 24/30.5 P; 24/577

[58] Field of Search ..... 24/16 PB, 17 AP, 24/30.5 P, 577

[56] References Cited

U.S. PATENT DOCUMENTS

| | | | |
|---|---|---|---|
| 3,000,384 | 9/1961 | Piers, Jr. | 24/17 AP |
| 3,050,578 | 8/1962 | Huebner | 24/17 AP |
| 3,072,986 | 1/1963 | Lefnaer | 24/16 PB |
| 3,438,095 | 4/1969 | Evans | 24/16 PB |
| 3,501,814 | 3/1970 | Anderson et al. | 24/16 PB |
| 3,530,543 | 9/1994 | Desmarais et al. | 24/16 PB |
| 3,604,145 | 9/1971 | Zimmerman | 24/16 PB X |
| 3,654,049 | 4/1972 | Ausnit | 24/16 PB |
| 3,869,764 | 3/1975 | Tanaka et al. | 24/577 |
| 3,955,246 | 5/1976 | Tanaka | 24/16 PB X |
| 3,983,603 | 10/1976 | Joyce | 24/16 PB |
| 4,183,121 | 1/1980 | Cousins | 24/577 |
| 4,870,721 | 10/1989 | Cohen | 24/16 PB |
| 5,619,909 | 4/1997 | Volk | 24/16 PB X |
| 5,640,744 | 6/1997 | Allan | 24/442 |

FOREIGN PATENT DOCUMENTS

| | | | |
|---|---|---|---|
| 0867116 | 5/1961 | United Kingdom | 24/16 PB |

*Primary Examiner*—Victor N. Sakran
*Attorney, Agent, or Firm*—Seed and Berry LLP

[57] ABSTRACT

A method for coupling at least two structures. The method comprises engaging the structures with a resilient, elongated band. The band has a plurality of spaced-apart projections extending away from a first portion thereof and a plurality of spaced-apart apertures positioned in a second portion thereof. The method further comprises receiving the projections in the apertures, and changing the shape of the projections and/or the apertures to bias the projections into engagement with the apertures.

21 Claims, 6 Drawing Sheets

METHOD FOR REMOVABLY COUPLING A PLURALITY OF STRUCTURES

TECHNICAL FIELD

The present invention is directed toward a method for removably coupling a plurality of structures by engaging projections of one portion of a coupling member with corresponding apertures of another portion of the coupling member.

BACKGROUND OF THE INVENTION

Complex electrical and electronic devices may have a large number of cables or wires routed between the various components, connectors, and terminals comprising each device. The cables may become damaged by contacting sharp edges or hot surfaces of components within the device if the cables are not tied down or restrained in some manner. In addition, if not bundled, the cables may become tangled and difficult to trace during diagnostic testing or when the cables must be repaired or replaced.

One approach to solving the foregoing problems has been to bundle the cables together with cable ties. A conventional cable tie may comprise a thin, flat band having an aperture positioned at one end and a tapered tab portion positioned at the opposite end. In operation, the tab portion of the band is inserted into the aperture to form a loop around the cables and the tab portion is drawn through the aperture to tighten the band around the cables. A small plastic or metal engaging member positioned in the aperture engages the portion of the band which passes therethrough and prevents it from loosening. Excess band material projecting from the aperture may then be trimmed off.

One drawback associated with the foregoing approach is that trimming the band requires an extra time-consuming operation. Furthermore, the material comprising the band is typically resilient and accordingly the band must be trimmed with a sharp tool. When trimming the band, the user may inadvertently damage the cables with the tool. In addition, the trimmed edge of the band may be sharp and may accordingly harm the user accessing the internal components of the electronic device. Conversely, if the excess portion of the band is not trimmed, it may obstruct visual and physical access to the internal components of the device, or may interfere with normal operation of the components.

Still a further drawback with the foregoing approach is that once installed, the cable tie cannot easily be removed because the engaging member is deliberately positioned to prevent the cable tie from loosening. As a result, the user may be required to cut the cable tie band with a sharp tool to access individual cables, and may inadvertently damage the cables when doing so. Furthermore, the band is not reusable once cut, and must therefore be replaced. Accordingly, the entire operation may become time-consuming, may incur additional material costs in the form of replacement cable ties, and may increase the likelihood that the cables will be damaged whenever the cable ties are removed or installed.

SUMMARY OF THE INVENTION

The present invention is a method for coupling first and second structures. In one embodiment, the method comprises engaging the first and second structures with a flexible band, receiving a first projection extending away from a first portion of the band in a corresponding first aperture positioned in a second portion of the band, and receiving a second projection extending away from the first portion of the band in a corresponding second aperture positioned in the second portion of the band.

In one embodiment, the method further comprises changing a shape of at least one of the first projection and the first aperture to bias the first projection into engagement with the first aperture, and changing a shape of at least one of the second projection and the second aperture to bias the second projection into engagement with the second aperture. In another embodiment, the method may comprise extending the band along a longitudinal axis between a first position and a second position, the band having a length in a direction generally aligned with the longitudinal axis which is greater when the band is in the second position than when the band is in the first position.

DETAILED DESCRIPTION OF THE INVENTION

The present invention is directed toward a method for removably coupling structures together. The method may be used to bundle electrical cables, couple a conduit to a support structure, or couple any of a myriad of other structures. FIGS. 1–9 illustrate various embodiments of the method, and like reference numbers refer to like parts throughout the figures.

Figure 1:
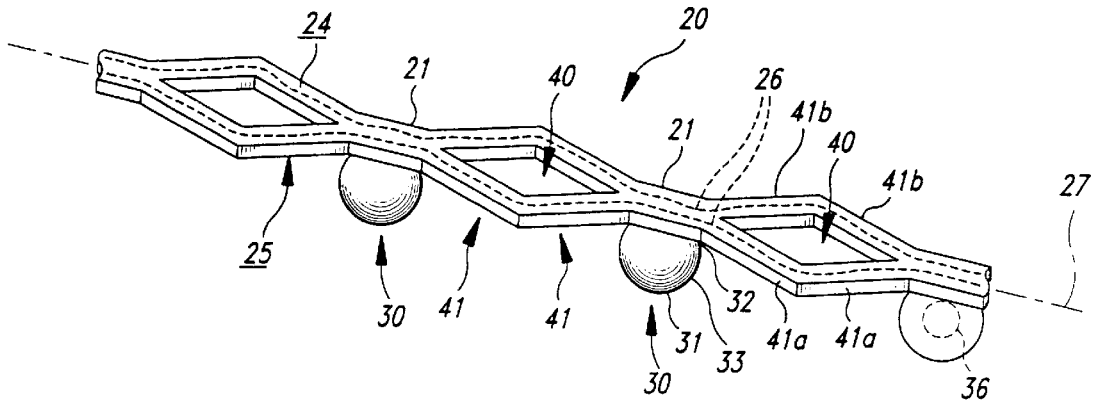
FIG. 1 is a top isometric view of a portion of a device that operates in accordance with an embodiment of the invention.

FIG. 1 is a top isometric view of a portion of a coupling member or band 20 which operates in accordance with an embodiment of the invention. The coupling member 20 has an upper surface 24 and a lower surface 25 facing opposite the upper surface. A plurality of spaced-apart apertures 40 extend through the coupling member 20 from the upper surface 24 to the lower surface 25. Connecting portions 21 are positioned at opposite ends of each aperture 40. Projections 30 depend from the connecting portions 21 and extend away from the lower surface 25. The projections 30 of one portion of the coupling member 20 may be interlocked with the apertures 40 of another portion of the coupling member to form a loop which may be positioned to couple together wires, cables, or other structures.

In one embodiment, the coupling member 20 is elongated along a longitudinal axis 27 and comprises a flexible, resilient material. The material may be sufficiently flexible perpendicular to the longitudinal axis 27 so that one portion of the coupling member 20 may be folded to overlap and couple with another portion of the coupling member, as will be discussed in greater detail below with reference to FIGS. 2A–2D. In one embodiment, the coupling member 20 and connecting portions 21 thereof comprise a rubber, plastic, nylon or other elastically deformable material. Accordingly, the coupling member 20 may be stretched along the longitudinal axis 27 and will tend to return to its unstretched position. The coupling member 20 may further include fiber reinforcements 26 which are generally aligned with the longitudinal axis 27 and which may prevent the coupling member from stretching beyond a selected point, such as the elastic limit of the material comprising the coupling member. The fiber reinforcements 26 may also increase the overall strength of the coupling member 20.

In one embodiment, the apertures 40 formed in the coupling member 20 are defined by aperture walls 41 which are formed integrally with the connecting portions 21. The aperture walls 41 may accordingly comprise a resilient, flexible material, substantially as discussed above with reference to the coupling member 20 generally, and may also include fiber reinforcements 26 to resist overstretching. The aperture walls 41 may extend at least partially outwardly transverse to the longitudinal axis 27 when the coupling member 20 is in the unstretched position, as shown in FIG. 1. Accordingly, when the coupling member 20 is stretched along the longitudinal axis 27, aperture walls 41*a* and 41*b* positioned on opposite sides of each aperture 40 tend to draw inwardly toward each other to engage a corresponding projection 30, as will be discussed in greater detail below. In one embodiment, the aperture walls 41 define a generally diamond-shaped aperture 40. In other embodiments, the aperture walls 41 define apertures 40 having other shapes, as will be discussed below with reference to FIGS. 4 and 5.

The projections 30 are positioned between the apertures 40 as shown in FIG. 1. The projections 30 have a generally spherical shape in the embodiment shown in FIG. 1, and may have other shapes in other embodiments, as will be discussed below with reference to FIGS. 7 and 8. Each projection 30 has a base region 32 adjacent the connecting portion 21, an end region 31 spaced apart from the connecting portion, and an intermediate region 33 between the base region and the end region. The end region 31 is tapered and narrows as the projection 30 extends away from the connecting portion 21. Accordingly, each projection 30 may be more easily inserted into a corresponding aperture 40. The intermediate region 33 bulges outwardly relative to the base region 32 so that when the projection 30 is fully inserted into the aperture 40 and the aperture walls 41 engage the base region, the projection 30 will resist being inadvertently pulled out of the corresponding aperture 40. In one embodiment, each projection 30 may comprise a flexible material which compresses or otherwise deforms when the projection is inserted into an aperture 40. In another embodiment, the projection 30 may have a void or hollow portion 36 therein so that it may be easily compressed. In yet another embodiment, the projection 30 may be substantially rigid and the corresponding aperture walls 41 may flex or deform when the projection is inserted therein.

Figure 2A:
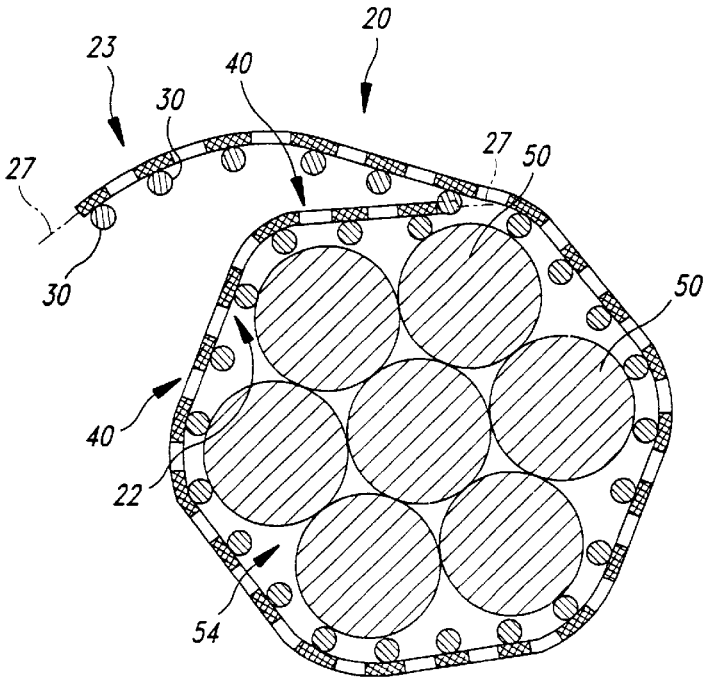
FIG. 2A is a cross-sectional view of the device of FIG. 1 shown in position to clamp a plurality of cables.
Figure 2B:
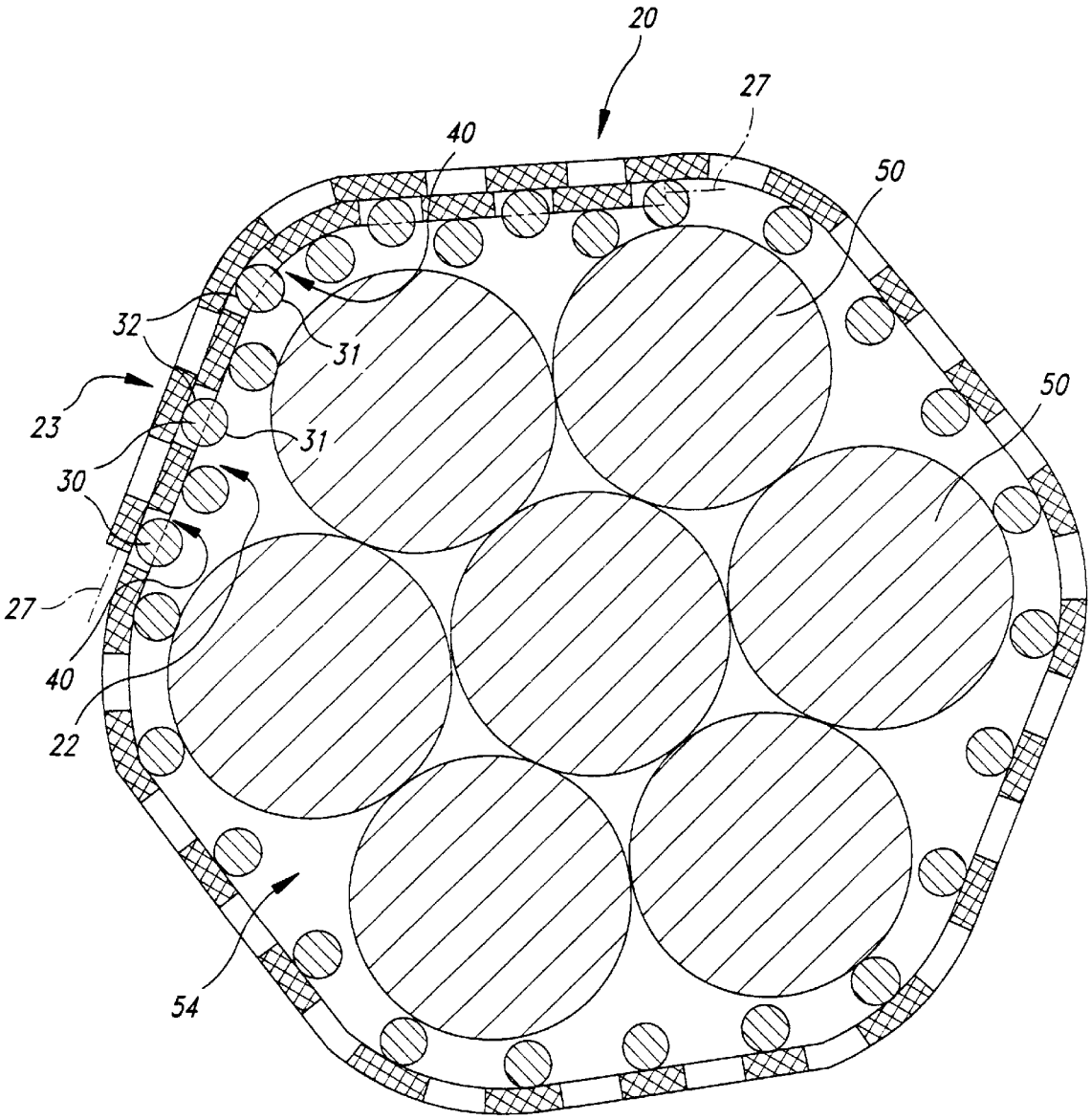
FIG. 2B is a cross-sectional view of the device of FIG. 2A shown clamping the plurality of cables.

Operation of an embodiment of the coupling member 20 is best understood with reference to FIGS. 1 and 2A–2B. FIG. 2A is a cross-sectional view of a coupling member 20 positioned around a plurality of cables 50 which form a cable bundle 54. As shown in FIG. 2A, the length of the coupling member 20 along the longitudinal axis 27 is greater than the circumference of the bundle 54, so that when it is wrapped around the bundle, the coupling member has an overlapping portion 23 positioned over an underlying portion 22. The coupling member 20 may be stretched as it is wrapped around the bundle 54 so that selected projections 30 of the overlapping portion 23 are aligned with selected apertures 40 of the underlying portion 22.

Once the projections 30 and apertures 40 are aligned, the projections may be inserted into the apertures 40, as shown in cross-sectional view in FIG. 2B. At this point, the apertures 40 may be slightly smaller than the projections 30 so that the projections engage the aperture walls 41 as the projections are inserted into the apertures. As the projections 30 are inserted into the apertures 40, the aperture walls 41 may expand slightly and/or the projections 30 may compress slightly so that the projections pass through the apertures. In one embodiment, the end regions 31 of the projections 30 project outwardly through the apertures 40 and the aperture walls 41 clamp the projections in the base regions 32 thereof. Because opposing aperture walls 41*a* and 41*b* (FIG. 1) tend to move toward each other when the coupling member 20 is stretched, the opposing aperture walls may tend to clamp the corresponding projection 30 therebetween. As discussed above, the intermediate region 33 of the projection 30 may be larger than the base region 32, to resist unintended motion of the projection 30 out of the aperture 40 once it has been inserted therein. If the user intends to remove the coupling member 20, the user may grasp the overlapping portion 23 and unwind it from the bundle 54, pulling the projections 30 out of the corresponding apertures 40.

In one embodiment, the entire overlapping portion 23 engages the underlying portion 22, and all the projections 30 of the overlapping portion are inserted into corresponding apertures 40 of the underlying portion. In a further aspect of this embodiment, the spacing between adjacent apertures 40 and between adjacent projections 30, as well as the elasticity of the coupling member 20 are chosen so that the projections may be easily aligned with the apertures. In a further aspect of this embodiment, the spacing of the projections 30 and apertures 40 and the flexibility of the coupling member 20 may be selected such that the user may engage any one projection with one of several apertures, depending upon how much the user stretches the coupling member. The user may accordingly determine how tightly the coupling member 20 engages the bundle 54 by selecting the appropriate apertures 40 in which to insert the corresponding projections 30.

One advantage of an embodiment of the coupling member 20 shown in FIGS. 1 and 2A–2B is that, when installed, it is possible for the coupling member to have no excess material projecting away from the bundle 54 which it encircles. Accordingly, the coupling member 20 may have no sharp edges which may harm surrounding components of a user accessing the cables 50 or components to which the coupling member is attached. Furthermore, by eliminating excess material, an embodiment of the coupling member 20 may be less likely to obstruct the user's access to the cables 50 or components, and may be less likely to become caught in the components.

A further advantage of the coupling member 20 shown in FIGS. 1 and 2 is that the excess material is eliminated by manually attaching the overlapping portion 23 to the underlying portion 22 without the use of tools. By eliminating the need for tools, the coupling member 20 may reduce the likelihood that the user will harm either the cables 50 or the user when installing or removing the coupling member. Still another advantage of the coupling member 20 is that it need not be destroyed or damaged when it is removed from the cables 50 around which it is positioned. Accordingly, the coupling member 20 may be reused after it has been removed and need not be replaced.

Yet another advantage of the coupling member 20 is that a coupling member having a given length may be used to secure bundles of cables 54 having a wide variety of circumferences. Where the length of the coupling member exceeds the circumference of the bundle, the overlapping portion 23 may be attached to the underlying portion 22. Where the length of the coupling member 20 is less than the circumference of the bundle 54, the coupling member may be stretched along the longitudinal axis 27. Also, several coupling members 20 may be connected in series to surround a bundle 54 having a circumference that is greater than the length of a single coupling member 20. Still a further advantage of an embodiment of the coupling member 20 is that a user may select how tightly the cables 50 are bundled by stretching the coupling member by the desired amount before engaging the projections 30 with the apertures 40.

Figure 2C:
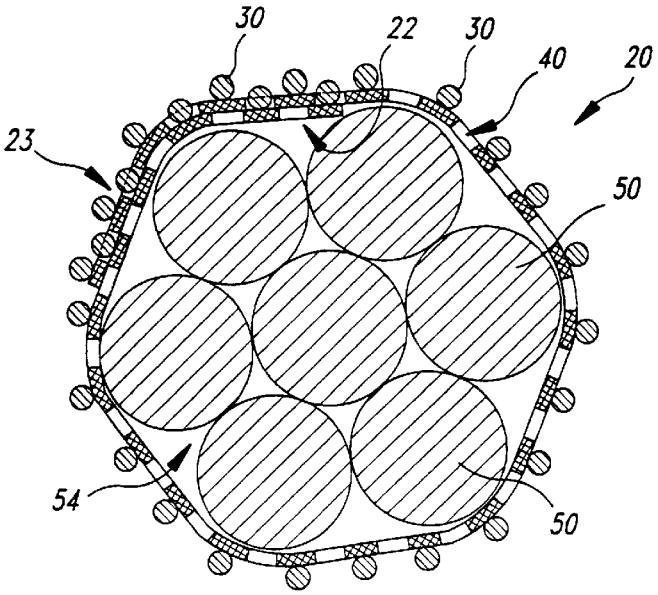
FIG. 2C is a cross-sectional view of the device of FIG. 1 shown encircling a plurality of cables, the device having projections facing outwardly away from the cables.

FIG. 2C is a cross-sectional view of the coupling member 20 of FIG. 1 shown encircling a cable bundle 54 and having the projections 30 thereof facing outwardly away from the cables 50. The coupling member 20 may be positioned as shown in FIG. 2C where it is preferable not to have the projections 30 engaging the cables 50 or other structures coupled by the coupling member 20. Conversely, an advantage of installing the coupling member such that the projections 30 face inwardly toward the cables 50, as shown in FIGS. 2A–2B, is that the projections may have a reduced tendency to catch or snag on neighboring devices or structures.

Figure 2D:
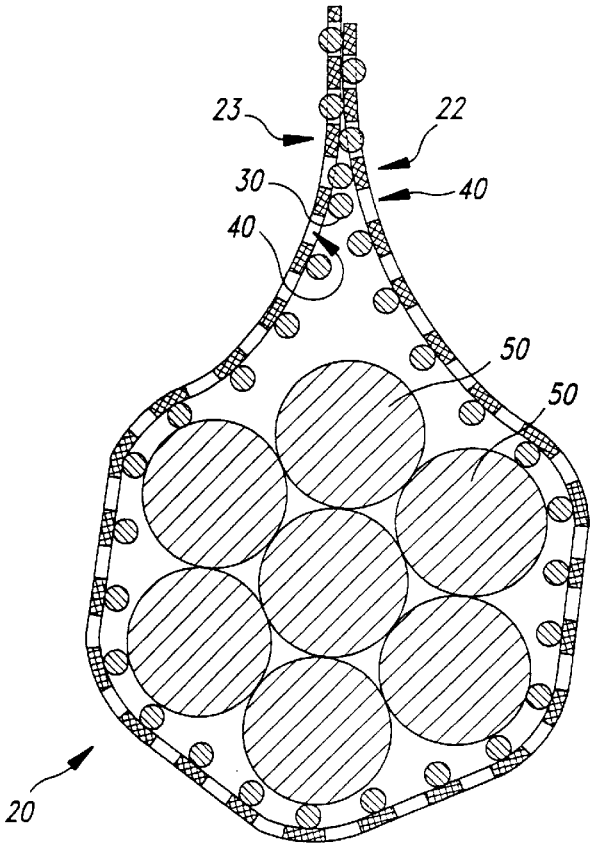
FIG. 2D is a cross-sectional view of the device of FIG. 1 wherein projections and apertures of an underlying portion of the device engage apertures and projections, respectively, of an overlapping portion of the device.

FIG. 2D is a cross-sectional view of the coupling member 20 of FIG. 1 wherein the projections 30 and apertures 40 of the underlying portion 22 engage corresponding apertures and projections, respectively, of the overlapping portion 23. An advantage of the installation arrangement shown in FIG. 2D may be that because the projections 30 of both the overlapping portion 23 and underlying portion 22 engage corresponding apertures 40 in the opposite portion, the bond formed between the overlapping and underlying portions 23 and 22 may be stronger, and the coupling member 20 may be less likely to loosen. Conversely, an advantage of the installation arrangement shown in FIGS. 2A–2B is that the overlapping and underlying portions may be more tightly wrapped around the cables 50 and may therefore be less likely to interfere with surrounding components or obstruct the motion of a user accessing the components.

In the embodiments shown in FIGS. 1 and 2A–2D, the coupling member 20 is stretchable along the longitudinal axis 27 because the connecting portions 21 and/or the aperture walls 41 comprise a flexible material. In addition, the coupling member 20 may be extendible along the longitudinal axis 27 because opposing aperture walls 41*a* and 41*b* may be drawn toward each other when the coupling member is stretched along the longitudinal axis, as discussed above. In another embodiment, the aperture walls 41 may be rigid, and the flexibility of the coupling member may be provided by the connecting portions 21 alone. The projections 30 may accordingly be flexible so as to be easily inserted into the apertures 40. In another embodiment, the aperture walls 41 may be rigid and may be pivotally or otherwise connected to each other so that they may move relative to each other, allowing the coupling member 20 to elongate along the longitudinal axis 27. In yet another embodiment, the connecting portions 21 may be rigid and the flexibility of the coupling member may be provided by flexible aperture walls 41 or by rigid and pivotally connected aperture walls. In still another embodiment, the coupling member 20 may not be stretchable along the longitudinal axis 27 so long as it is sufficiently flexible to wrap upon itself, as shown in FIG. 2B, and so long as the aperture walls 41 and the projections 30 are positioned to firmly engage each other. In any of the foregoing embodiments, the apertures 40 and projections 30 may be sufficiently small and closely spaced so that the overlapping portion 23 may be easily coupled to the underlying portion 22 over a wide range of bundle circumferences.

As shown in FIGS. 1–2D, a single aperture 40 is positioned between two projections 30 and a single projection is positioned between two apertures. In other embodiments, a greater number of apertures 40 may be positioned between each pair of projections 30, or a greater number of projections may be positioned between each pair of apertures.

As is also shown in FIGS. 1–2D, the coupling member 20 may have projections 30 and apertures 40 which are evenly distributed over the entire length thereof. In another embodiment, one portion of the coupling member 20, such as the overlapping portion 23, may have projections 30 and no apertures 40 and another portion, such as the underlying portion 22, may have apertures and no projections. In another embodiment, the respective positions of the projections 30 and apertures 40 may be reversed. An advantage of either embodiment is that the coupling member 20 may be less costly to manufacture than the coupling member shown in FIGS. 1–2D. Conversely, an advantage of the coupling member 20 shown in FIGS. 1–2D is that by having projections 30 and apertures 40 distributed along the entire length thereof, the coupling member may more easily encircle cable bundles 54 having a wide variety of circumferences.

Figure 3:
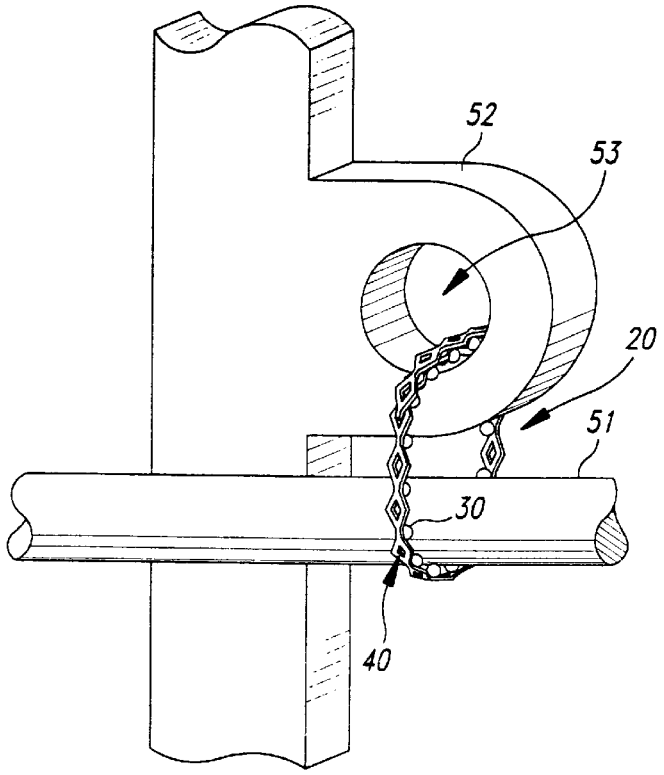
FIG. 3 is a top isometric view of the device of FIG. 1 shown positioned to couple one structure to another.

FIG. 3 is an isometric view of the device of FIG. 1 shown positioned to couple a first structure 51, such as a pipe or conduit, to a second structure 52, such as a support member. Accordingly, the coupling member 20 may be sized to have a strength sufficient to support the structures to which it is attached. In the embodiment shown in FIG. 3, the coupling member 20 may be coupled around the first structure 51 and through an aperture 53 of the second structure 52. In other embodiments, the coupling member 20 may be used to connect any of a myriad of devices or structures together.

An advantage of an embodiment of the coupling member 20 shown in FIG. 3 is that it may be used to quickly attach structures to each other. The structures may be just as quickly detached and, as discussed above, the coupling member 20 may be reused after it has been removed.

Figure 4:
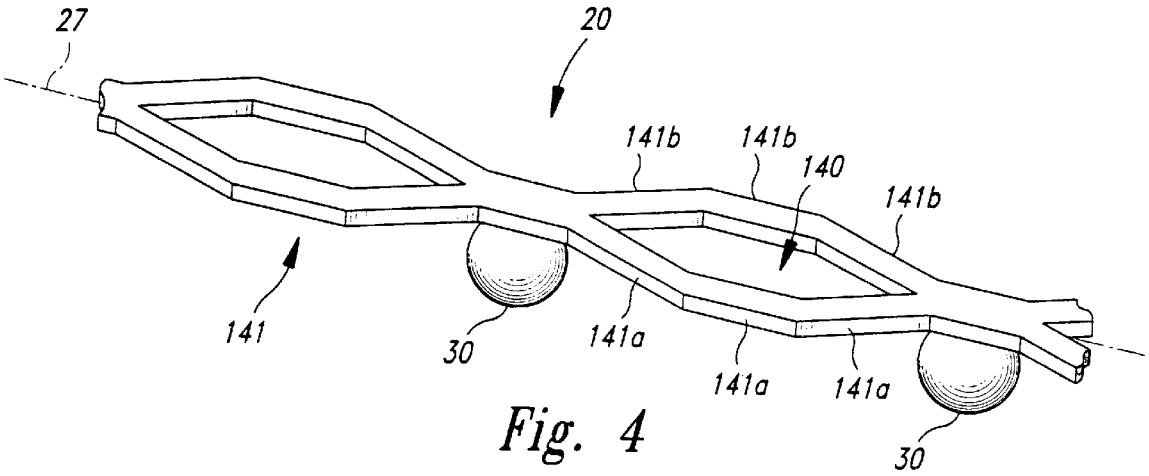
FIG. 4 is a top isometric view of a portion of a device having hexagonal-shaped apertures and which operates in accordance with another embodiment of the invention.
Figure 5:
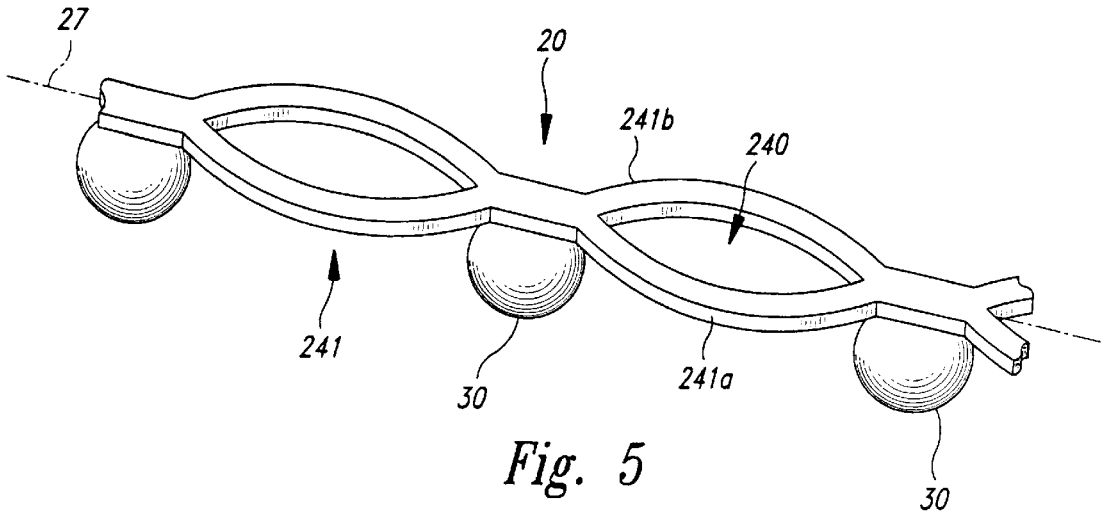
FIG. 5 is a top isometric view of a portion of a device having elliptical apertures and which operates in accordance with yet another embodiment of the invention.

FIGS. 4 and 5 are isometric views of portions of coupling members 20 which operate in accordance with other embodiments of the invention and which have apertures with shapes other than the diamond shape shown in FIGS. 1–3. The coupling member 20 shown in FIG.4 has hexagonally-shaped apertures 140, and the coupling member shown in FIG. 5 has elliptically apertures 240. The apertures 140 and 240 are both elongated along the longitudinal axis 27. Opposing aperture walls 141*a* and 141*b* shown in FIG. 4 and 241*a* and 241*b* shown in FIG. 5 tend to draw toward each other as the coupling member 20 is stretched along the longitudinal axis 27, in a manner substantially as described above with reference to FIGS. 1 and 2A–2B. In other embodiments, the coupling member 20 may have apertures with other shapes, so long as the apertures are sized to receive the projections 30 therein and to resist inadvertent motion of the projections out of the apertures.

Figure 6:
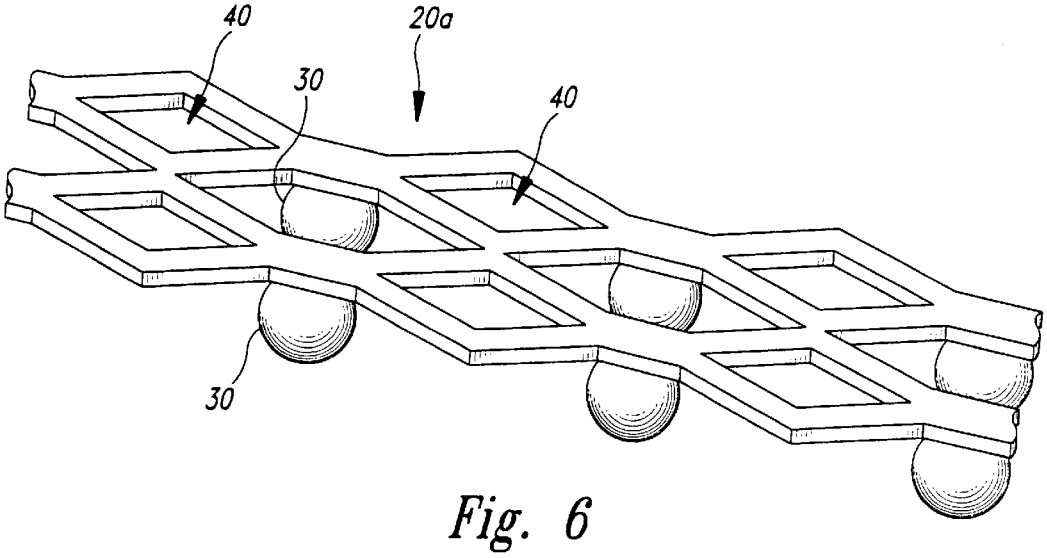
FIG. 6 is a top isometric view of a portion of a device having two parallel rows of apertures and projections and which operates in accordance with still another embodiment of the invention.

FIG. 6 is a top isometric view of a portion of coupling member 20*a* having two parallel rows of apertures 40 and projections 30, and which operates in accordance with still another embodiment of the invention. The additional projections 30 and apertures 40 provide additional coupling sites between the overlapping portion 23 and the underlying portion 22 when the coupling member 20*a* is positioned to bundle cables 50, or couple other structures as discussed above with reference to FIGS. 1–3. In other embodiments, the coupling member 20*a* may comprise more than two rows of apertures 40 and projections 30. The coupling member 20*a* may accordingly be provided with a number of parallel rows of apertures 40 and projections 30 which is sufficient to form a strong bond between the overlapping portion 23 and underlying portion 22, without requiring that the user spend an unnecessary amount of time and energy installing and/or removing the coupling member.

Figure 7:
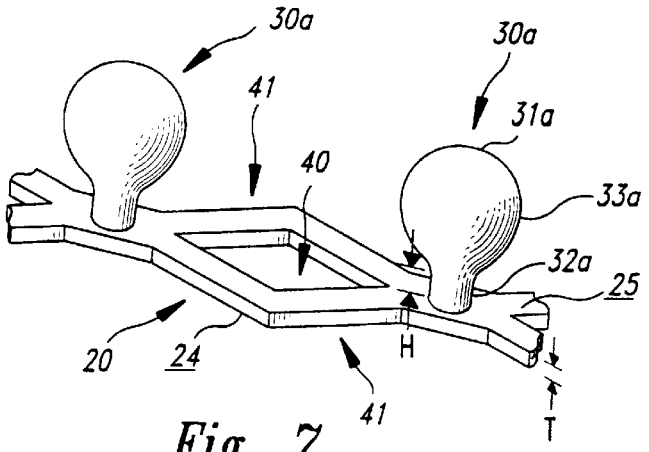
FIG. 7 is a bottom isometric view of portion of a device having bulb-shaped projections and which operates in accordance with still another embodiment of the invention.

FIG. 7 is a bottom isometric view of a portion of a coupling member 20 having bulb-shaped projections 30*a* and which operates in accordance with still another embodiment of the invention. As shown in FIG. 7, the base portion 32*a* of each projection 30*a* comprises a short cylindrical section which is then coupled to a generally spherical intermediate region 33*a* and end region 31*a*. In one embodiment, a height H of the base portion 32*a* is equal to or greater than a thickness T of the coupling member 20. Accordingly, an advantage of the cylindrical base region 32*a* when compared with the spherical base region 32 shown in FIG. 1, is that the aperture walls 41 may snap into place around the cylindrical base region when the projection 30*a* is inserted into the aperture 40. Conversely, an advantage of the spherical base region 32 shown in FIG. 1 is that the sloped surfaces thereof may tend to bias the aperture walls 41 of the aperture 40 into which the projection 30 is inserted toward the lower surface 24 adjacent the projection. Accordingly, the aperture walls 41 may more snugly engage the lower surface 25 of the coupling member 20. Additionally, the spherical projections 30 shown in FIG. 1 may be easier to remove from the apertures 40 when it is desired by the user to do so.

Figure 8:
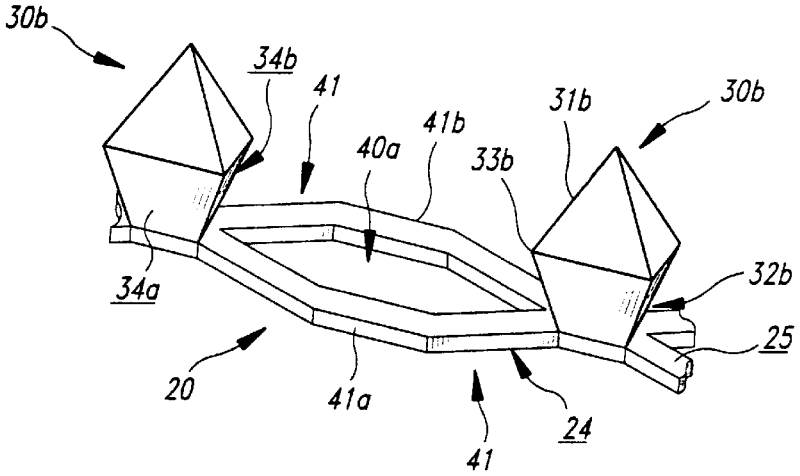
FIG. 8 is a bottom isometric view of a portion of a device having pyramidal-shaped projections and which operates in accordance with still another embodiment of the invention.

FIG. 8 is a bottom isometric view of a portion of a coupling member 20 having pyramidally-shaped projections 30*b* and which operates in accordance with still another embodiment of the invention. As shown in FIG. 8, the pyramidal projections 30*b* each include a base region 32*b* which is tapered toward the lower surface 25 of the coupling member 20, an intermediate region 33*b* which is wider than the base region 32*b*, and an end region 31*b* which is tapered to be narrower than the intermediate region 33*b*. Accordingly, the pyramidal projections 30*b* may be easily inserted into corresponding apertures 40*a* and may be engaged and locked in place by the aperture walls 41. An advantage of the pyramidal-shaped projections 30*b* is that the flat sidewalls of the base region 32 may be easily engaged by the flat aperture walls 41. In one embodiment, wherein the coupling member 20 has hexagonally-shaped apertures 40*a*, opposite flat sidewalls 34*a* and 34*b* of the base region 32*b* may be aligned with aperture walls 41*a* and 41*b* of the aperture 40 into which the projection 30*b* is inserted. Accordingly, the pyramidal projections 30*b* may be firmly engaged by hexagonal-shaped apertures 40*a*.

Figure 9:
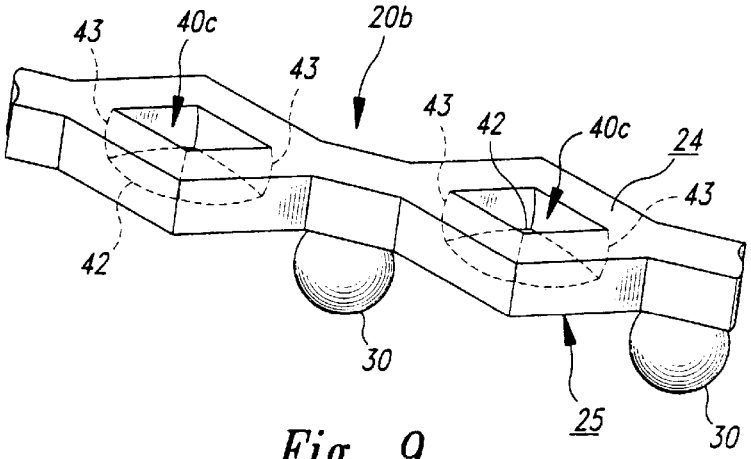
FIG. 9 is a top isometric view of a portion of a device having blind apertures therein and which operates in accordance with still another embodiment of the invention.

FIG. 9 is a top isometric view of a coupling member 20*b* having blind apertures 40*c* therein and which operates in accordance with still another embodiment of the invention. As shown in FIG. 9, the apertures 40*c* extend from the upper surface 24 of the coupling member 20*b* into the coupling member and terminate in an end wall 42 which is spaced apart from the lower surface 25. The projections 30 may be inserted into the apertures 40*c*, substantially as discussed above but will not extend completely through the coupling member 20 as do the projections shown in FIGS. 1–8. In one embodiment, each aperture 40*c* may have curved interior walls 43, shaped to engage the curved surfaces of the projection 30. Where the projection 30 has another exterior shape, the aperture 40*c* may have correspondingly-shaped interior walls 43.

An advantage of the coupling member 20*b* shown in FIG. 9 is that the projections 30 do not project through the apertures 40 when the coupling member is installed. Accordingly, the coupling member 20*b* may be wrapped upon itself several times, forming a plurality of overlapping and underlying portions. By wrapping the coupling member 20*b* upon itself several times, a greater number of projections 40 may be engaged with corresponding apertures 30, which may reduce the likelihood that the coupling member will inadvertently uncouple. Conversely, an advantage of the coupling member 20 shown in FIG. 1 is that it is not as thick as the coupling member 20*b* shown in FIG. 9 and may accordingly be more flexible and require fewer materials to fabricate.

From the foregoing it will be appreciated that, although specific embodiments of the invention have been described herein for purposes of illustration, various modifications may be made without deviating from the spirit and scope of the invention. Accordingly, the invention is not limited except as by the appended claims.

I claim:

1. A method for coupling first and second structures, comprising:

engaging the first and second structures with a flexible band;

receiving a first projection extending away from a first portion of the band in a corresponding first aperture positioned in a second portion of the band;

receiving a second projection extending away from the first portion of the band in a corresponding second aperture positioned in the second portion of the band such that the first and second projections are positioned on opposite sides of a third projection extending away from the second portion of the band between the first and second apertures;

changing a shape of at least one of the first projection and the first aperture to bias the first projection into engagement with the first aperture and secure the first projection in position in the first aperture; and changing a shape of at least one of the second projection and the second aperture to bias the second projection into engagement with the second aperture and secure the second projection in position in the second aperture.

2. The method of claim 1 wherein the act of receiving the first projection includes passing at least a portion of the first projection through the first aperture from one side of the band to an opposite side of the band.

3. The method of claim 1 wherein the flexible band has a first surface and a second surface opposite the first surface, further wherein the first aperture has an open end at the first surface and a closed end proximate to the second surface and the act of receiving the first projection includes inserting the first projection at least partially into the open end of the first aperture.

4. The method of claim 1, further comprising:

removing the first projection from the first aperture; and removing the second projection from the second aperture.

5. A method for bundling a plurality of elongated members, comprising:

encircling the elongated members with a flexible band;

inserting a first projection extending away from a first portion of the band into a corresponding first aperture positioned in a second portion of the band;

inserting a second projection extending away from the first portion of the band into a corresponding second aperture positioned in the second portion of the band such that the first and second projections are positioned on opposite sides of a third aperture in the first portion of the band;

changing a shape of at least one of the first projection and the first aperture to bias the first projection into engagement with the first aperture and secure the first projection in position in the first aperture; and changing a shape of at least one of the second projection and the second aperture to bias the second projection into engagement with the second aperture and secure the second projection in position in the second aperture.

6. The method of claim 5 wherein the act of encircling the elongated members includes positioning at least one of the projections to face toward at least one of the elongated members.

7. The method of claim 5 wherein the act of encircling the elongated members includes positioning at least one of the projections to face away from at least one of the elongated members.

8. The method of claim 5 wherein the act of encircling the elongated members includes stretching the band.

9. The method of claim 5 wherein the act of changing a shape of at least one of the first projection and the first aperture includes elastically deforming walls of the first aperture by forcing at least a portion of the first projection into the first aperture.

10. The method of claim 5 wherein the act of changing a shape of at least one of the first projection and the first aperture includes elastically deforming the first projection by forcing at least a portion of the first projection into the first aperture.

11. A method for bundling a plurality of cables, comprising:

encircling the cables with a flexible band, the band being elongated along a longitudinal axis and having a first portion with first and second projections extending away therefrom and having a second portion with first and second apertures therein;

extending the band along the longitudinal axis between a first position and a second position after encircling the cables, the band having a length in a direction generally aligned with the longitudinal axis, the length being greater when the band is in the second position then when the band is in the first position;

inserting the first projection into the first aperture after extending the band; and inserting the second projection into the second aperture to couple the band around the cables.

12. The method of claim 11, further comprising overlapping the first portion with the second portion.

13. The method of claim 11 wherein the act of encircling the cables includes positioning at least one of the projections to face toward at least one of the cables.

14. The method of claim 11 wherein the act of encircling the cables includes positioning at least one of the projections to face away from at least one of the cables.

15. The method of claim 11 wherein the act of extending the band includes stretching material comprising the band.

16. The method of claim 11 wherein the act of extending the band includes changing a shape of at least one of the first and second apertures.

17. The method of claim 11 wherein the act of inserting the first projection includes elastically deforming walls of the first aperture by forcing at least a portion of the first projection into the first aperture.

18. The method of claim 11 wherein the act of inserting the first projection includes elastically deforming the first projection by forcing at least a portion of the first projection into the first aperture.

19. The method of claim 11 wherein the first portion of the flexible band has third and fourth apertures therein and the second portion of the flexible band has third and fourth projections extending away therefrom, further comprising:

inserting the third projection into and through the third aperture; and inserting the fourth projection into and through the fourth aperture.

20. The method of claim 11 wherein inserting the first projection into the first aperture includes inserting the first projection through the first aperture.

21. A method for coupling first and second structures, comprising:

engaging the first and second structures with a flexible band, the flexible band having a first surface and a second surface opposite the first surface;

receiving a first projection extending away from a first portion of the band in a corresponding first aperture positioned in a second portion of the band such that the first projection is inserted at least partially into an open end of the first aperture at the first surface of the flexible band and proximate to a closed end of the first aperture proximate to the second surface of the flexible band;

receiving a second projection extending away from the first portion of the band in a corresponding second aperture positioned in the second portion of the band;

changing a shape of at least one of the first projection and the first aperture to bias the first projection into engagement with the first aperture; and changing a shape of at least one of the second projection and the second aperture to bias the second projection into engagement with the second aperture.

* * * * *